US005119642A

United States Patent [19]

Cannon

[11] Patent Number: 5,119,642

[45] Date of Patent: Jun. 9, 1992

[54] EARRING ATTACHMENT

[76] Inventor: Jesse D. Cannon, P.O. Box 3581, Longview, Tex. 75606

[21] Appl. No.: 804,973

[22] Filed: Dec. 11, 1991

[51] Int. Cl.[5] ..... A44C 7/00

[52] U.S. Cl. ..... 63/12; 63/13

[58] Field of Search ..... 63/1.1, 2, 12, 13, 14.1, 63/14.4, 14.7; 24/705

[56] References Cited

U.S. PATENT DOCUMENTS

| | | | |
|---|---|---|---|
| 227,581 | 5/1880 | Rieger | 63/12 |
| 271,084 | 1/1883 | Krementz | 63/12 |
| 527,359 | 10/1894 | Bonner | 63/13 |
| 2,797,561 | 7/1957 | Vaughn | 63/13 |
| 2,971,353 | 2/1961 | Germana | 63/14.7 |
| 3,446,034 | 5/1969 | Driscoll . | |
| 4,003,216 | 1/1977 | Cecere | 63/12 |
| 4,803,852 | 2/1989 | Waldron | 63/13 |
| 4,907,424 | 3/1990 | Reinstein | 63/12 |
| 4,944,164 | 7/1990 | Butler | 63/12 |
| 5,077,987 | 1/1992 | Leith | 63/13 |

*Primary Examiner*—Renee S. Luebke
*Assistant Examiner*—F. Saether
*Attorney, Agent, or Firm*—Norman B. Rainer

[57] ABSTRACT

A device adapted to be vertically associated with an earring jacket has an elongated housing that pivotably holds a post for a pierced ear, and slidably holds an elongated bar having an apertured upper extremity. The post can be pivoted downwardly to a storage state and the bar can be raised to permit penetration of the upper extemity of the bar by a stud-type earring.

7 Claims, 2 Drawing Sheets

EARRING ATTACHMENT

BACKGROUND OF THE INVENTION

1. Field of the Invention

This invention relates in general to earrings, and more particularly concerns an attachment for an earring of the type worn on pierced ears.

2. Description of the Prior Art

Decorative devices worn on the ears, and known as earrings, may be removably attached to the wearer's ear by clamp means or a portion of the earring which penetrates a small aperture pierced through the ear, said latter type of earring being generally referred to as a pierced earring. In one kind of pierced earring, the portion which penetrates the ear is wire-like, having a hook or loop configuration that holds the earring in place. In another kind of pierced earring, the portion that penetrates the ear is a straight rigid post. A fastener, usually spring biased, engages the extremity of the post that penetrates the ear, thereby holding the earring in place.

A popular variation of the post-type pierced earring is a stud earring wherein the ornamental feature is a relatively small, generally circularly symmetric object such as a precious gem which is directly attached to the rigid post. When such stud earrings are worn, a further option is to utilize the same post to penetrate and thereby pendantly support another decorative object, generally referred to as a "jacket". The jacket has an inner surface directed toward the ear and a visibly distinctive outer surface, and may have any configuration, provided it can be penetrated by the post at a thin section which will not occupy much of the length of the post. By combining the stud earring with different jackets, many variations in appearance may be achieved while simultaneously providing the wearer the satisfaction of creative accomplishment in fashioning earrings of novel appearance.

Many jackets would in themselves constitute desirable earrings if there were some way of attaching them to the ear without the need for the stud earring. If the jackets could thereby be employed as earrings, it would increase even further the number of appearance combinations available to the wearer.

It is accordingly an object of the present invention to provide an attachment device for a jacket that enables the jacket to function as a post-type pierced earring.

It is a further object of this invention to provide an attachment device as in the foregoing object which can be easily and securely adjusted by the wearer to permit use of the jacket either as an earring or as a jacket.

It is another object of the present invention to provide an attachment device of small size adapted to be unobtrusively affixed to the inner surface of the jacket.

These objects and other jackets and advantages of the invention will be apparent from the following description.

SUMMARY OF THE INVENTION

The above and other beneficial objects and advantages are accomplished in accordance with the present invention by a device for an earring jacket comprising:

c) a housing adapted to be vertically associated with a jacket and having a flat base elongated between upper and lower extremities, paired parallel sidewalls emergent from said base and defining a groove which opens in a direction opposite said base, aligned circular apertures in said sidewalls adjacent said upper extremity and a guide channel disposed within said groove adjacent said lower extremity in spaced apart, substantially parallel relationship to said base, b) an earring post attached to a holding block having opposed parallel flat surfaces and a circular bore extending orthogonally between said surfaces, said holding block adapted to fit closely within said groove in a manner whereby said circular bore is in coaxial disposition with said aligned apertures, c) a pivot pin penetrating said aligned apertures and circular bore, thereby permitting pivoting movement of said holding block and enabling said earring post to be moved between a position extending orthogonally away from said base and a position wherein said earring post lies within said groove, and d) an elongated straight spring bar slidably held within said guide channel and having an apertured top extremity and bottom extremity, both extremities being enlarged to prevent passage through said guide channel.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
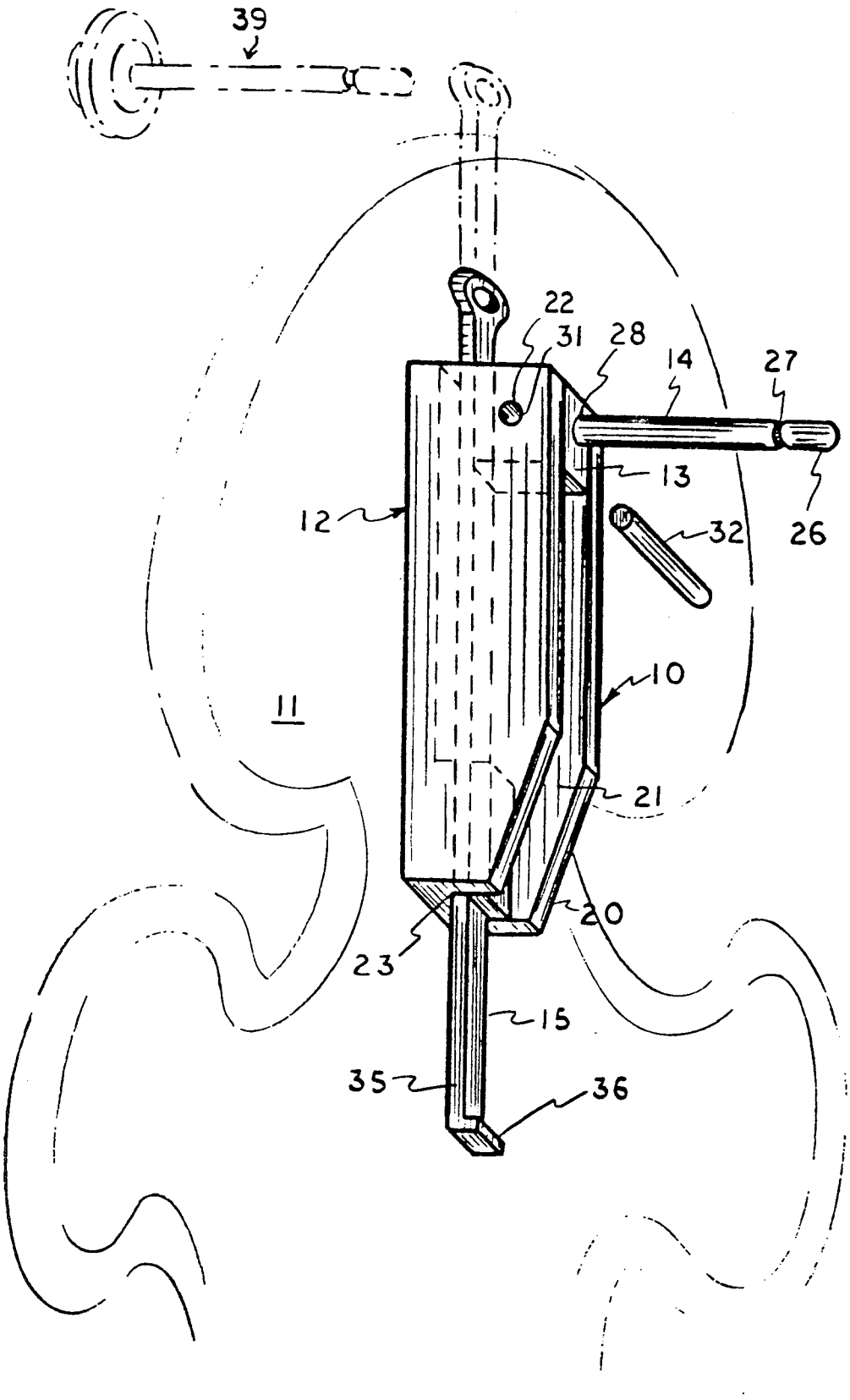
FIG. 1 is a partly exploded perspective view of an embodiment of the device of the present invention showing the earring post in its deployed upright position.
Figure 2:
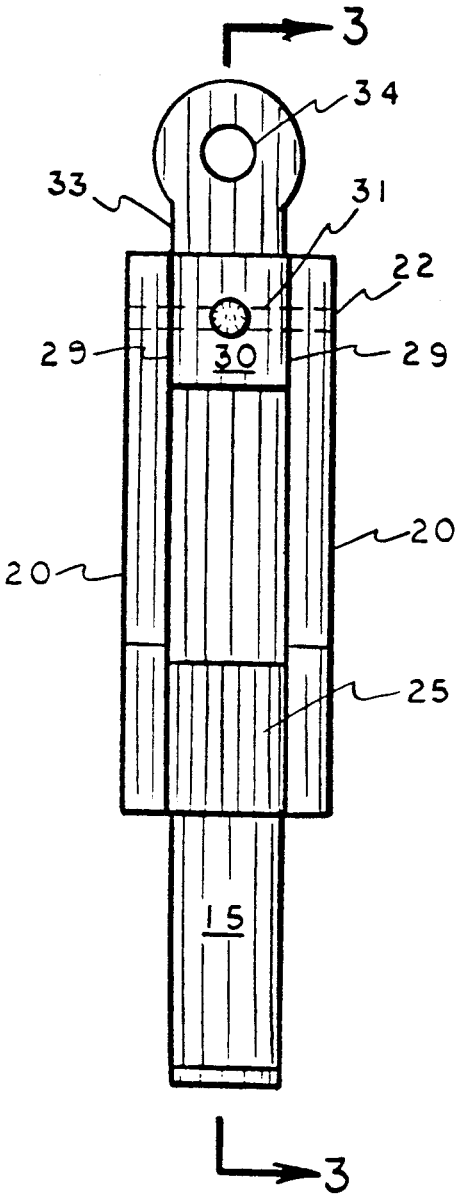
FIG. 2 is a side view taken from the right side of FIG. 1.

Referring to FIGS. 1-5, an embodiment of the device 10 of the present invention is shown attached to the upper interior surface of a conventional earring jacket 11 shown in phantom outline. The exemplified embodiment of attachment device 10 is shown comprised of housing 12 which embraces holding block 13 carrying earring post 14, and further confines elongated straight spring bar 15.

Housing 12, adapted to be vertically associated with jacket 11, has a base 16 having flat exterior surface 17 elongated between upper and lower extremities 18 and 19, respectively. Exterior surface 17 may be joined to jacket 11 by welding, adhesives or the like, or may be integral with said jacket. Paired parallel sidewalls 20 are emergent from said base and define therewith a groove 21 which opens in a direction opposite to base 16. Aligned circular apertures 22 are located in sidewalls 20 adjacent upper extremity 18. A guide channel 23 is disposed within groove 21 adjacent lower extremity 19, and formed by spacer pedestal 24 attached to base 16, and spaced apart parallel holding plate 25.

Earring post 14 has a distal extremity 26 adapted to penetrate the wearers ear, an annular recess 27 adjacent extremity 26 to receive a conventional fastener device, and a proximal extremity 28 secured by holding block 13. Said holding block is provided with opposed parallel flat surfaces 29 adapted to slidably fit between sidewalls 20, and is further bounded by four transverse surfaces 30, causing the holding block to have a substantially cubic shape. Although the holding block may have other shapes, it is important that the transverse surface orthogonally opposite the surface that holds the post be flat. It is also important that the holding block is shaped to provide a cam action when rotated so as to deflect spring bar 15, as well be shown hereinafter.

A circular bore 31 extends orthogonally between surfaces 29 in coaxial disposition with aligned apertures 22. A pivot pin 32 penetrates aligned apertures 22 and bore 31, thereby imparting pivoting movement to said holding block and enabling earring post 14 to be moved between a position extending orthogonally away from said base, as shown in FIG. 1, and a shortage position within groove 21, as shown in FIG. 3.

Spring bar 15 is shown as having a substantially uniform rectangular cross section and slidably held within guide channel 23. The top extremity 33 of spring bar 15 is provided with a mounting hole 34, and is enlarged beyond the otherwise uniform cross-sectional contour of the spring bar. The reason for such enlargement is to prevent the spring bar from passing downwardly entirely through channel 23 and thereby falling away from the housing. Likewise, bottom extremity 35 of spring bar 15 is enlarged in one dimension by virtue of abutment tab 36, thereby preventing upward passage of the spring bar completely through channel 23.

In the operation of the device of this invention, when it is desired to employ the jacket as a post-type earring, spring bar 15 is pushed to its lowermost position with respect to housing 12, and earring post 14 is pivoted to a position orthogonal to said housing. The position of the earring post is stabilized because the cam action of transverse surfaces 30 momentarily deflects spring bar 15, and then a flat transverse surface comes to rest in tensioned abutment with said spring bar. It is to be noted that a region of empty space 37 exists between spring bar 15 and base 16 adjacent holding block 13, thereby permitting the requisite deflection of spring bar 15.

Figure 3:
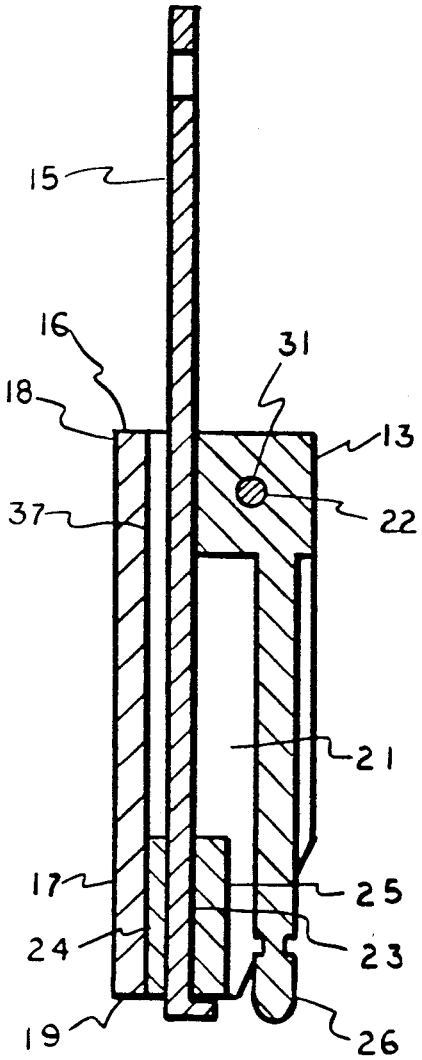
FIG. 3 is a sectional view taken upon the line 3—3 of FIG. 2 but showing the earring post in its folded down storage position.
Figure 4:
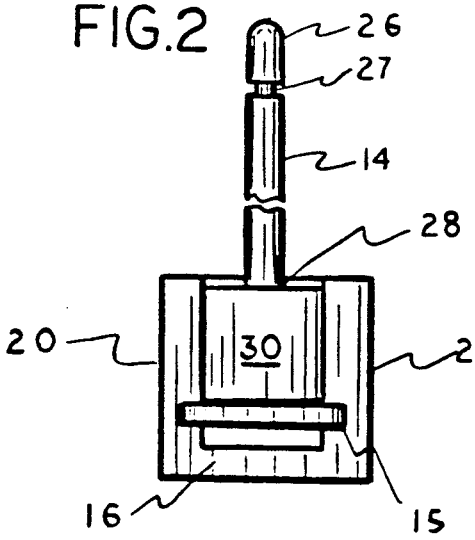
FIG. 4 is a top end view of FIG. 1.
Figure 5:
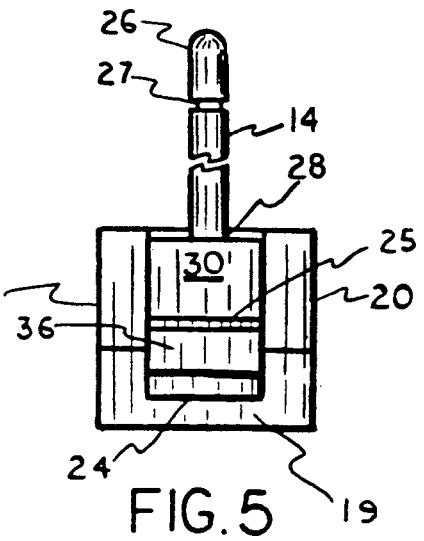
FIG. 5 is a bottom end view of FIG. 1.

When it is desired to utilize the jacket in conjuction with a supplemental stud-type earring 39, earring post 14 is pivoted to its downward, stored position, and spring bar 15 is raised to its uppermost position, as shown in FIG. 3 and in phantom outline in FIG. 1. In this state, the post of the supplemental stud-type earring can be inserted through mounting hole 34 and thence through the hole in the wearer's ear.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A device for an earring jacket comprising:

a) a housing adapted to be associated with a jacket and having a flat base elongated between upper and lower extremities, paired parallel sidewalls emergent from said base and defining a groove which opens in a direction opposite said base, aligned circular apertures in said sidewalls adjacent said upper extremity, and a guide channel disposed within said groove adjacent said lower extremity in spaced apart, substantially parallel relationship to said base, b) an earring post attached to a holding block having opposed parallel flat surfaces and a circular bore extending orthogonally between said surfaces, said holding block adapted to fit closely within said groove in a manner whereby said circular bore is in coaxial disposition with said aligned apertures, c) a pivot pin penetrating said aligned apertures and circular bore, thereby permitting pivoting movement of said holding block and enabling said earring post to be moved between a position extending orthogonally away from said base and a position wherein said earring post lies within said groove, and d) elongated straight spring bar slidably held within said guide channel and having an apertured top extremity and a bottom extremity, both extremities being enlarged to prevent passage through said guide channel.

2. In combination, an earring jacket characterized by having an interior surface and opposed ornamental exterior surface, and a device of claim 1 durably associated with said interior surface.

3. The device of claim 1 wherein said earring post has a distal extremity, and a proximal extremity attached to said holding block, said earring post further having an annular recess adjacent said distal extremity adapted to receive a conventional fastener device.

4. The device of claim 1 wherein said holding block is provided with opposed parallel flat surfaces adapted to slidably fit between said sidewalls.

5. The device of claim 4 wherein said holding block is further bounded by one or more transverse surfaces.

6. The device of claim 5 wherein one of said transverse surfaces is flat and disposed in orthogonally opposition to said post.

7. The device of claim 1 wherein a region of empty space exists between said spring bar and flat base.

* * * * *